United States Patent [19]

Pote et al.

[11] 4,247,031

[45] Jan. 27, 1981

[54] METHOD FOR CRACKING AND SEPARATING PELLETS FORMED ON A WAFER

[75] Inventors: Thomas W. Pote, Gladstone; William E. Ham, Mercerville, both of N.J.

[73] Assignee: RCA Corporation, New York, N.Y.

[21] Appl. No.: 28,873

[22] Filed: Apr. 10, 1979

[51] Int. Cl.[3] ..... B26F 3/00

[52] U.S. Cl. ..... 225/2; 225/96.5

[58] Field of Search ..... 225/2, 96.5

[56] References Cited

U.S. PATENT DOCUMENTS

| | | | |
|---|---|---|---|
| 3,206,088 | 9/1965 | Meyer et al. | 225/2 |
| 3,222,963 | 12/1965 | Nabiullin et al. | 225/96.5 X |
| 3,392,440 | 7/1968 | Yanagawa | 225/2 X |
| 3,461,537 | 8/1969 | Lotz | 225/2 X |
| 3,493,155 | 2/1970 | Litant et al. | 225/2 |
| 3,507,426 | 4/1970 | Bielen et al. | 225/2 |
| 3,542,266 | 11/1970 | Woelfle | 225/2 |
| 3,601,296 | 8/1971 | Pick | 225/2 X |
| 3,677,875 | 7/1972 | Althouse | 225/2 |

*Primary Examiner*—Frank T. Yost

*Attorney, Agent, or Firm*—Birgit E. Morris; D. S. Cohen; Lawrence P. Benjamin

[57] ABSTRACT

A method for protecting electronic circuitry formed on the obverse side of a wafer from flying debris produced either by the mechanical or laser scribing or scoring of the wafer and during separation. The device is provided with a layer of abrasion resistant material on the circuit side of the wafer and the scribing or scoring is done on the obverse side of the wafer. The cracking operation is performed by applying pressure to the wafer in such a manner as to have the reverse side in tension and the obverse or circuit side in compression in order to prevent any debris which may have been cast up during the scribing or scoring operation from contaminating or damaging the circuit side of the wafer while any debris cast up during the breaking operation is thrown away from the obverse or circuit side.

5 Claims, 3 Drawing Figures

METHOD FOR CRACKING AND SEPARATING PELLETS FORMED ON A WAFER

Figure 1:
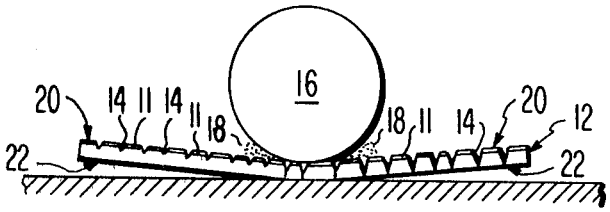
PRIOR ART Fig. 1

This invention relates to methods for fabricating semiconductor devices and more particularly to a method of dividing a processed wafer into smaller, elemental pieces suitable for packaging.

As is well known in the semiconductor fabrication art, the electronic circuitry for the individual chips, during fabrication, are formed in such a manner as to be neatly arranged in rows and columns on a wafer. For example, depending upon circuitry of the individual chip as many as 200–300 chips, each being about 0.150 inches square, may be formed on a 3 inch diameter wafer. At the completion of the wafer fabrication process, selected individual chips are probed to determine the efficacy of the fabrication process and those chips that fail the probing tests are marked with an ink spot for subsequent removal. The wafer is then scribed or scored in rows and columns, to define the individual chips, after which the entire wafer is then broken along the scribed lines in order to form the individual chips. The previously marked bad chips are then discarded and the good chips are mounted in a suitable package.

In those devices where the wafer is made of silicon, the prior art methods teach that the wafer first be scribed (on the circuit side) then placed on a plastic or protective sheet with the circuit sides of the wafer in contact with the plastic. The wafer is then bent about a mandrel. The wafer is first divided into rows along the scribed lines after which the wafer is rotated 90°, bent about a mandrel again, and broken into the individual chips or pellets. In some instances, a plastic or protective sheet is placed on both sides of the wafer. Typical examples of such processes are shown in U.S. Pat. No. 3,206,088 issued to A. Meyer et al. on Sept. 14, 1965 and U.S. Pat. No. 3,461,537 issued to J. Lotz on Aug. 19, 1969.

However, while the prior processes are valid for silicon wafers, it has been found that a considerably higher number of reject chips are encountered when fabricating circuits on insulating substrates such as sapphire, spinel or monocrystalline aluminum oxide using the prior art teachings. For example, it has been found that when a wafer of sapphire is scored and broken in order to define the individual chip, an inordinate amount of debris is formed and cast up due to the fact that the sapphire is more brittle and harder than monocrystalline silicon, thus causing damage to the exposed surface of the finished chips. If the wafer is scribed or scored on the obverse or circuit side, the debris cast up by the scribing or scoring operation damages the circuitry formed thereon. However, if one were to scribe or score the sapphire wafer on the reverse side using the prior art teaching, the pressure of the scribing operation and the subsequent rotation of the wafer (in order to achieve 90° wafer rotation) would also damage the circuitry formed on the obverse side.

Since the principal result of the contamination is damage done on the obverse side of the wafer by the debris cast up during the scribing or scoring operation, it has been determined that the yield losses due to such damage may be eliminated by providing the obverse side with abrasive resistance and thus minimize the sapphire debris problem.

Accordingly, we propose that the obverse or circuit side of a sapphire wafer be first provided with a relative thick, removable protective layer that will adhere to the circuit side of the wafer, and thereafter, that the scribing or scoring operation be performed on the reverse side of the wafer. By first applying the protective member to the obverse side of the wafer and thereafter scribing or scoring on the reverse side, the wafer is completely protected. In order for the wafer to be completely broken into its component chips, pressure is applied to the wafer in such a manner as to have the reverse side in tension and the obverse or circuit side in compression. This prevents any debris that may have been cast up during the scribing or scoring operation from contaminating or damaging the circuit side of the wafer while any debris cast up during the breaking operation is thrown away from the obverse side.

Accordingly, it is important to protect the obverse side of the wafer from both flying debris and from excessive pressures on the wafer produced by either the mechanical scribing or the vacuum required to hold the wafer to a plate. When the protection is provided and the scribing is done either mechanically or, for example by a laser operation, considerably less damage would be done to the finished circuits resulting in a higher yield.

In accordance with the present invention, a relatively thick, adherent protective layer is applied only to the obverse side of the wafer after the processing is completed and the wafer is turned with the obverse side face down. Since the wafer consists of devices formed on a transparent sapphire substrate, no particular alignment difficulties arise in order to scribe lines on the reverse side of the wafer. The wafer is scribed in one direction with parallel lines separating adjacent circuits, rotated 90° and scribed again in order to maintain the chip separation. Thereafter, the wafer is transferred to a breaking operation wherein, for example, the wafer is bent about a mandrel which is maintained parallel to one set of scribing marks resulting in the formation of columns of chips. The columns of the wafer, which are maintained in place by the adherent plastic layer, are rotated 90° and again bent about the mandrel to separate the columns into individual chips from the next adjacent chips. Thereafter, the previously inked chips, which represent the unsatisfactory circuits, are easily removed with a vacuum device in the form of a pencil. Thus, after the scribing and breaking operation the individual chips are still maintained in their respective position and may be easily removed and mounted in a suitable mount.

IN THE DRAWING

Figure 2:
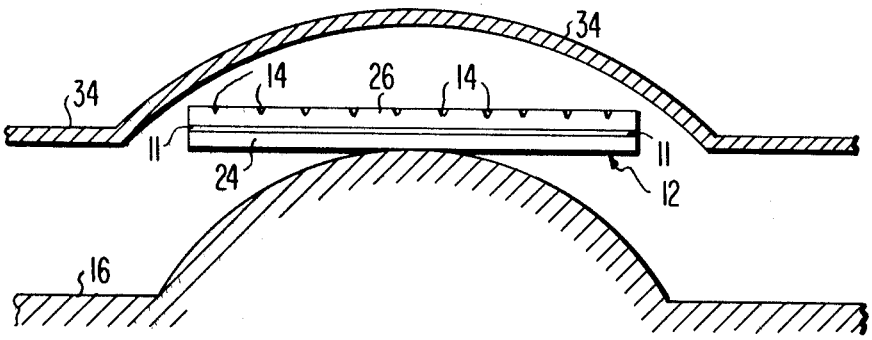
Figure 3:
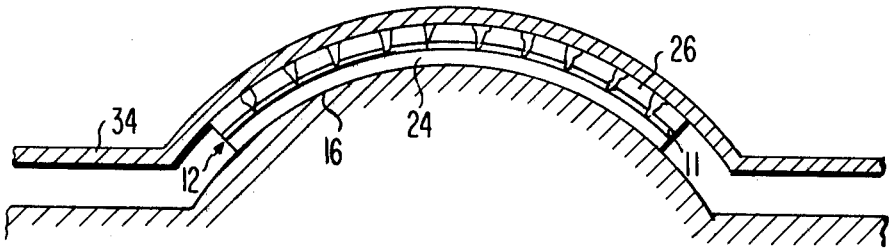

FIG. 1 depicts the prior art processing step of breaking or cracking the wafer along the previously scribed marks; and FIGS. 2 and 3 are successive process steps utilizing the protective cushion of the subject invention to facilitate cracking or breaking along the previously scribed marks.

While the following exegesis will be presented in terms of utilizing a sapphire substrate for the formation of silicon-on-sapphire (SOS) devices, it will be understood by those skilled in the art that this process may be utilized with other insulative substrates such as spinel or monocrystalline beryllium oxide, the finished chips being generically referred to as silicon-on-sapphire devices.

Referring now to FIG. 1 it will be seen that the prior art process for cracking or breaking the sapphire wafer as shown, for example, in the Lotz reference, consists of a wafer 12 in which there have been previously scribed marks 14. The wafer, with scribe marks 14 and circuit elements are facing and being bent about mandrel 16. Thus, during the breaking operation, the debris in the form of fragments 18 will cast up and adhere to both the obverse surface 20 and on the reverse surface 22. The debris in the form of fragments 18, which are cast on both surfaces, cause the damage to the finished devices during subsequent cracking operation when the wafer is rotated 90°.

Referring now to FIGS. 2 and 3 it will be seen that the drawback of the prior art method is obviated by using a protective coating 24 between the circuits 11 formed on wafer 12 and mandrel 16 and that the scoring or scribing has been done on the reverse side of the wafer. In these Figures, structure 12 is provided with a protective cover 24 which has been placed on the side of wafer having circuits 11 thereon. The wafer consists of a sapphire base 26 and is shown with scribed marks 14 which have been formed in the sapphire on the reverse side thereof in rows and columns corresponding to the chips 11 of the obverse side of the wafer.

Layer 24 may be applied by any one of a number of methods including painting or spinning the soft adherent plastic on the surface of wafer 26. It has been found that good results may be achieved by using a layer of, for example, soft tape having a very mild adhesive in order that the circuitry formed on the wafer is not contaminated. One reason for utilizing this type of coating is the extreme simplicity with which it may be applied and removed and equally important because it prevents the pellets or separated chips from separating from each other during the breaking operation. The prime consideration is that intimate contact be maintained between the layer 24 and circuitry 11 formed on the obverse side of the wafer since the sapphire debris usually is cast up during the breaking operation.

It has been our experience that the best commercially available material, for this purpose, appears to be a layer of material called "Amberlith" or "Rubylith" or any colorless version thereof. "Rubylith" and "Amberlith" are registered trademarks of the Ulano Company of New York City, New York. While these materials are basically similar, it has been found that "Amberlith" is slightly more transparent than "Rubylith" but a colorless version is preferable. The principal requirements for the material is that it be soft, that it stretch readily, and that it return to its prior condition. By way of example, a coating or a layer of "Amberlith" with a thickness of about 2 mils has nearly ideal adhesive qualities since it is readily soluble in commercially available organic solvents that would normally be used in the cleaning operation of a semiconductor device.

Structure 32 is shown as being placed at the highest point of mandrel 16 which may either be in the form of an elongated device having a length at least equal to the diameter of the structure 12 or, in the alternative, may be in the form of a convex hemisphere having a surface area at least equal to the surface area of structure 12. Immediately above structure 12, and having a configuration that would mate with mandrel 16 is a band 34 having a length at least equal to the length of the mandrel in the event the mandrel is elongated or, in the event that the mandrel 16 is in the form of a convex hemisphere, band 34 is concave to complement the configuration of mandrel 16.

In operation, as shown in FIG. 3, mandrel 16 is forced upward to mate with band 34 and the forces thus applied to structure 12 will separate the wafer along scribe marks 14. In the event mandrel 16 is of the elongated type it is now necessary to rotate the structure 12 90° and perform the breaking operation again to now separate and break the wafer along the column scribe marks thus forming the individual chips which may be subsequently mounted and utilized.

In the event that mandrel 16 has a convex hemispherical configuration it wil be obvious that this operation has to be performed only once since the device will be broken along both the row and scribe marks in one operation.

Thus, the basic premise of our invention is maintained. The circuit or obverse side of the wafer is protected by a plastic layer, the scribing is done on the reverse side and the circuit side is maintained in compression at all times during the breaking operation.

What is claimed is:

1. A method of separating individual semiconductor circuit elements from a wafer on the obverse side of which the individual circuit elements were formed, the wafer being scored along lines arranged in rows and columns to define the boundary limits of the individual circuit elements comprising the steps of:

applying a soft, resilient, adherent protective layer to the circuit elements on the obverse side of the wafer, the layer characterized by having the ability to return to its original form after being deformed;

scoring the wafer on the reverse side thereof to define the boundary limits of the individual circuit elements; and applying a breaking force to the obverse side of the wafer to separate the individual circuit elements, one from the other, along the scored lines.

2. The method of claim 1, wherein:

the wafer is selected from the group consisting of sapphire, spinel or monocrystalline aluminum oxide; and the circuit elements are formed in silicon islands on the obverse side of the wafer.

3. The method of claim 2, wherein:

the breaking force is applied by means of a round, elongated mandrel; and the mandrel is forced under pressure, across the obverse side of the wafer.

4. The method of claim 3, wherein:

the mandrel is first forced across the wafer in a direction parallel to the scored row lines; and the mandrel is next forced across the wafer in a direction parallel to the scored column lines.

5. The method of claim 2, comprising the further steps of:

providing a mandrel with a convex hemispherical shape having a surface area at least equal to the surface area of the wafer;

providing a complementary concave surface for mating with the convex hemisphere;

positioning the wafer on the convex hemisphere with the scored reverse side facing the concave surface; and forcing the convex hemisphere and the concave surface into mating relationship whereby the wafer therebetween is broken into individual circuit elements along the scored lines.

* * * * *